US006450884B1

(12) United States Patent
Seelig et al.

(10) Patent No.: US 6,450,884 B1
(45) Date of Patent: Sep. 17, 2002

(54) GAMING DISPLAY DEVICE

(75) Inventors: Jerald C. Seelig; Lawrence M. Henshaw, both of Pleasantville, NJ (US)

(73) Assignee: Atlantic City Coin & Slot Service Company, Inc., Pleasantville, NJ (US)

( * ) Notice: Subject to any disclaimer, the term of this patent is extended or adjusted under 35 U.S.C. 154(b) by 0 days.

(21) Appl. No.: 09/644,279

(22) Filed: Aug. 22, 2000

Related U.S. Application Data

(63) Continuation-in-part of application No. 09/535,075, filed on Mar. 23, 2000, now Pat. No. 6,338,678.

(60) Provisional application No. 60/149,143, filed on Aug. 23, 1999, provisional application No. 60/151,257, filed on Aug. 27, 1999, and provisional application No. 60/178,047, filed on Jan. 24, 2000.

(51) Int. Cl.[7] ..... A63F 3/06; A63F 7/00

(52) U.S. Cl. ..... 463/17; 463/20; 463/22; 273/138.2; 273/144 B; 273/143 R

(58) Field of Search ..... 273/274, 144 A, 273/144 B, 138.1, 138.2, 143 R; 463/17–19, 22, 20

(56) References Cited

U.S. PATENT DOCUMENTS 4,871,171 A * 10/1989 Rivero ..... 273/138.2
5,088,737 A * 2/1992 Frank et al. ..... 273/138.2
5,380,007 A * 1/1995 Travis et al. ..... 273/138.2
5,848,932 A * 12/1998 Adams ..... 463/20

OTHER PUBLICATIONS

Virginia Lottery: Pick 4 Prizes Could Double, Oct./Nov., 1992.*

* cited by examiner

*Primary Examiner*—Benjamin H. Layno
(74) *Attorney, Agent, or Firm*—Ian F. Burns

(57) ABSTRACT

A display device comprising a plurality of prize balls, a ball holder adapted to hold the balls in an individually controlled manner, a controller adapted to select a prize ball, a display mechanism adapted to display the selected prize ball to the player; and a positioning mechanism in communication with the controller adapted to position the selected prize ball relative to the display mechanism. The display device may be combined with a jumbled ball display wherein the balls displayed by the display device appear to originate from the jumbled ball display. The display device may also be combined with a game apparatus that is adapted to allow players to play a game. In this embodiment, the display device may provide a bonus award for the player. Several games are also provided that may be used with the display device. In an alternative embodiment, the jumbled ball display is replaced with a video display device that displays the balls in video form. The display device may also be replaced by the video display device in which case a prize ball appears to be randomly selected from the agitated display balls.

85 Claims, 10 Drawing Sheets

FIG. 1A
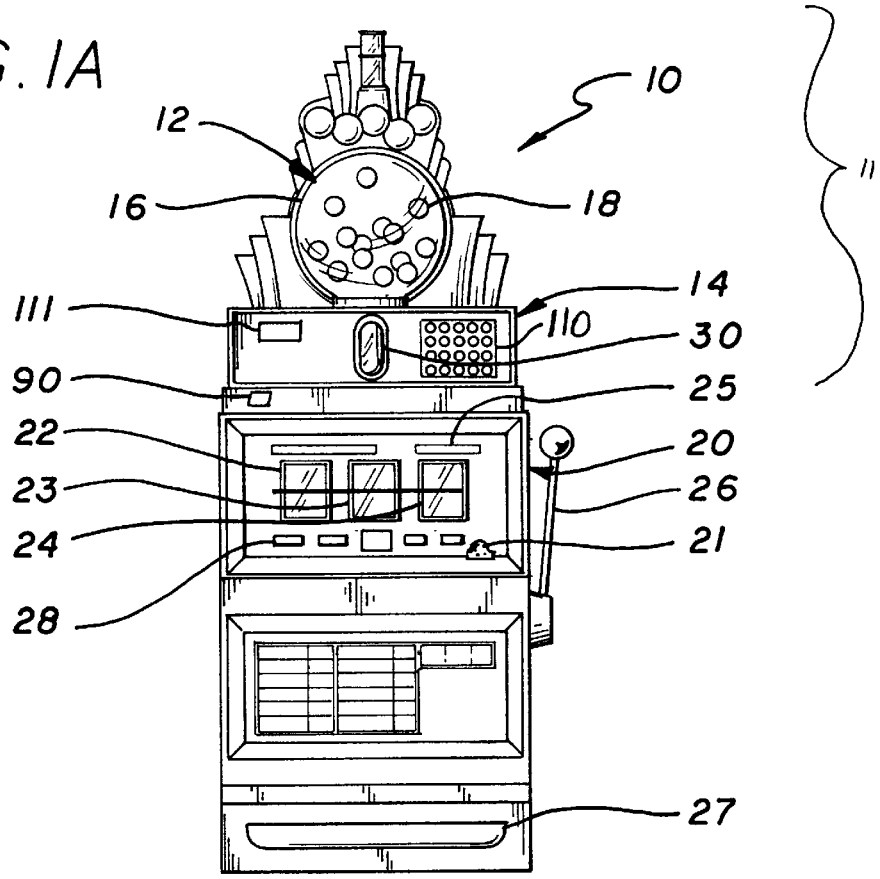
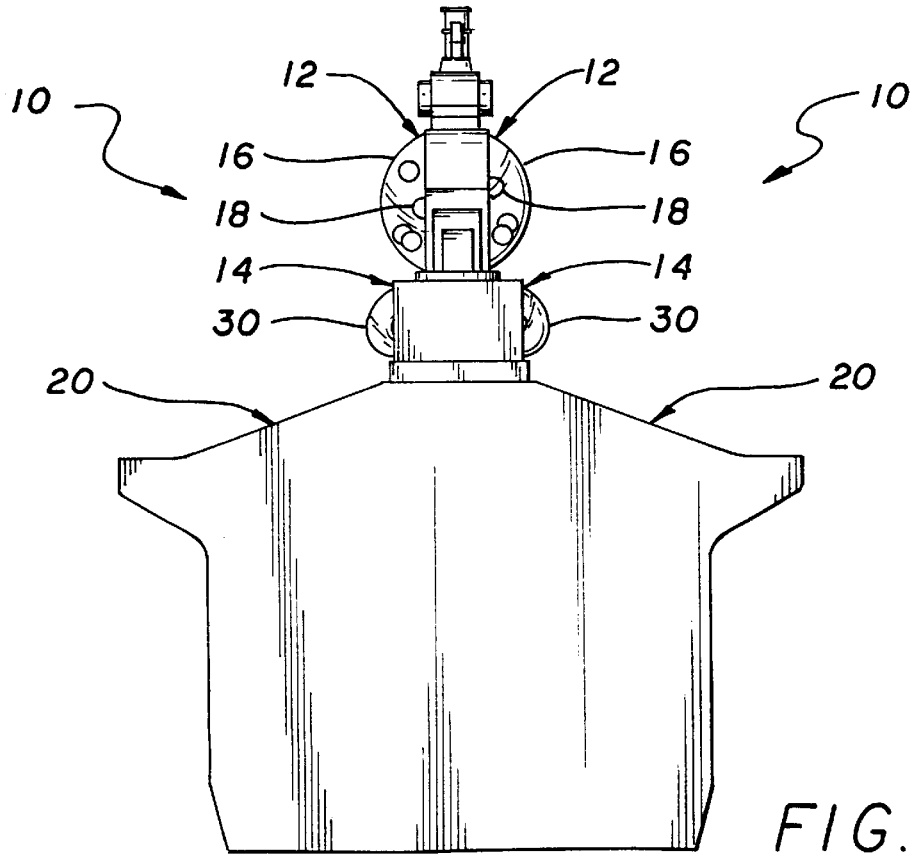
FIG. 1B

FIG. 3
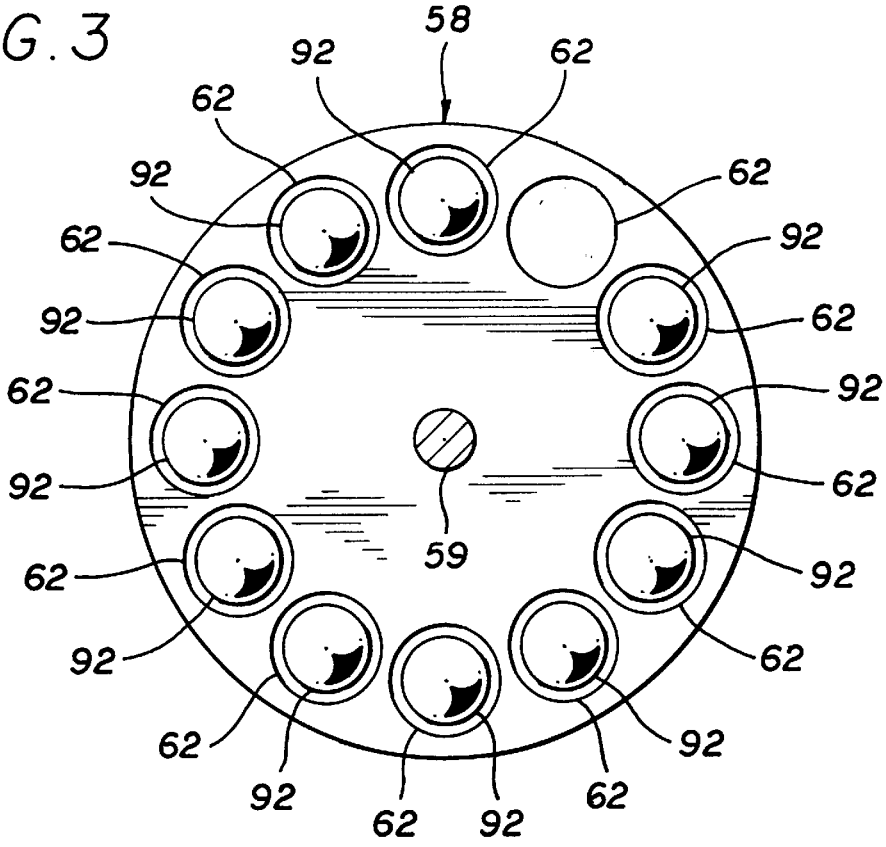
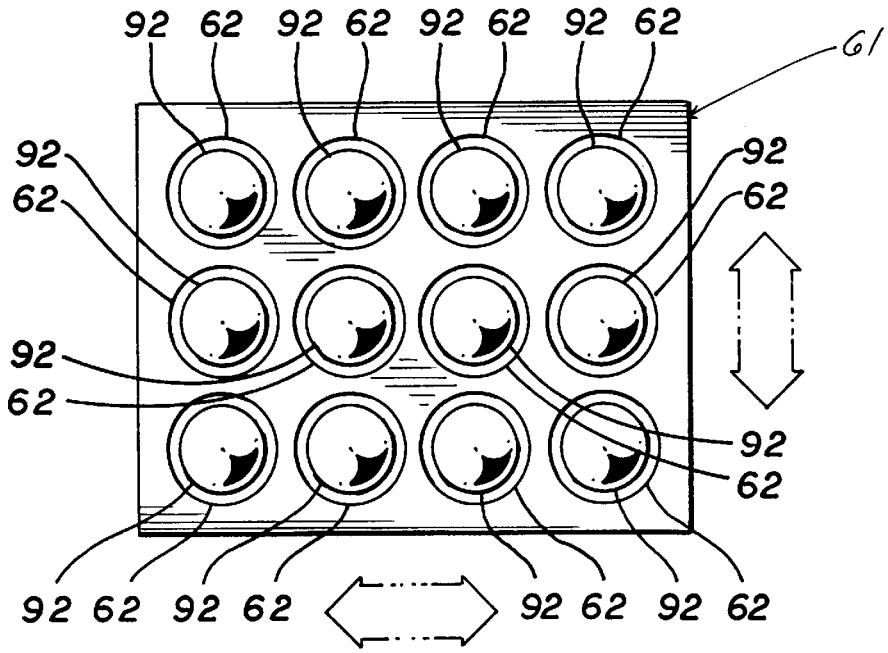
FIG. 4

FIG. 6
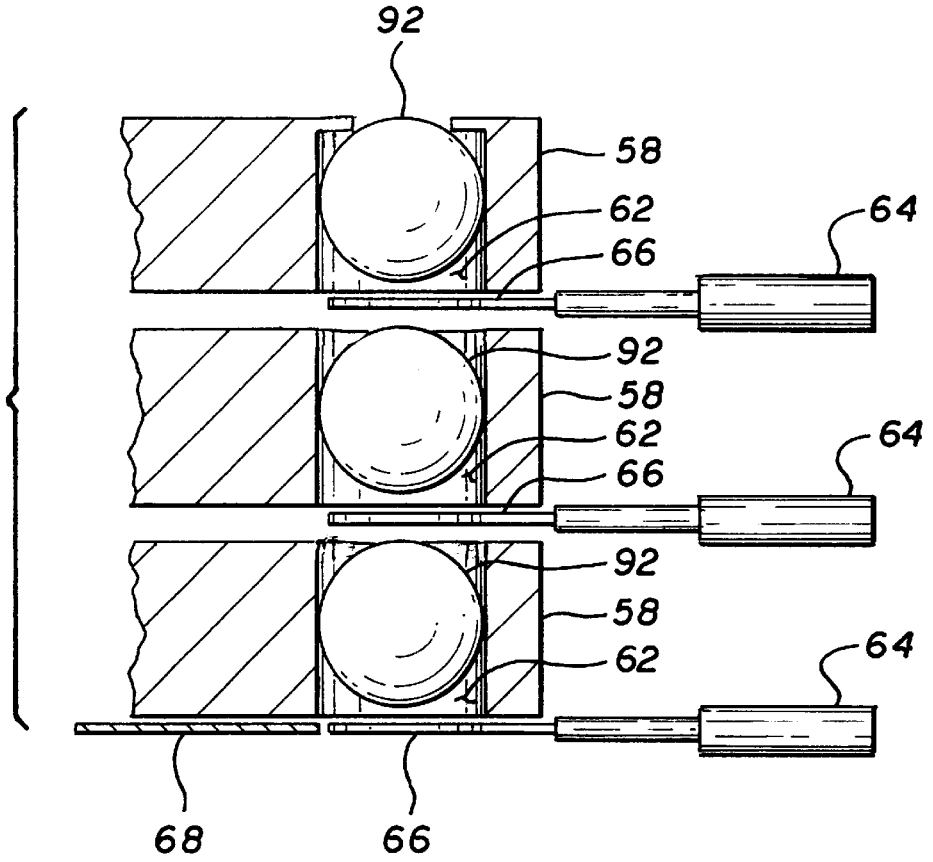
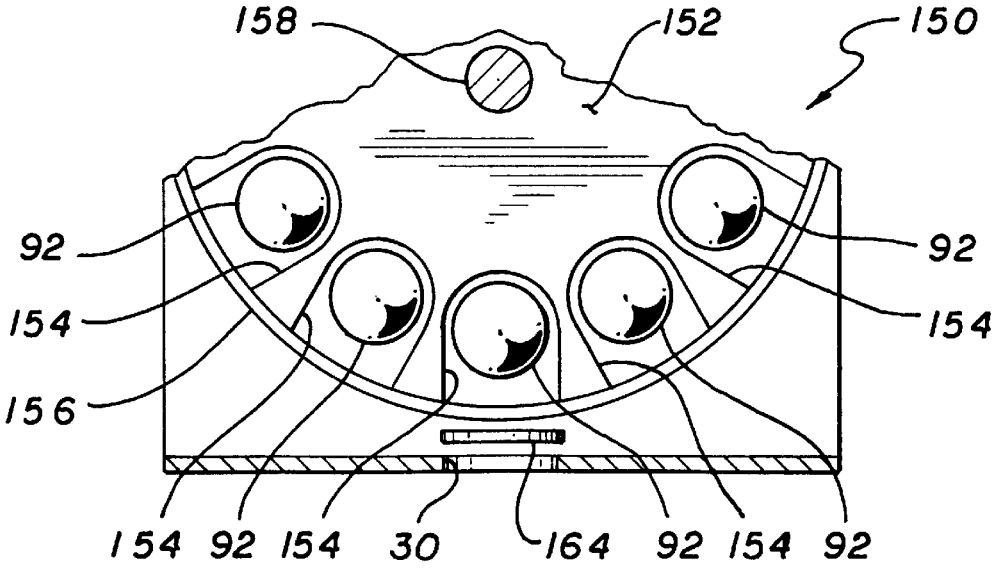
FIG. 7

FIG. 8
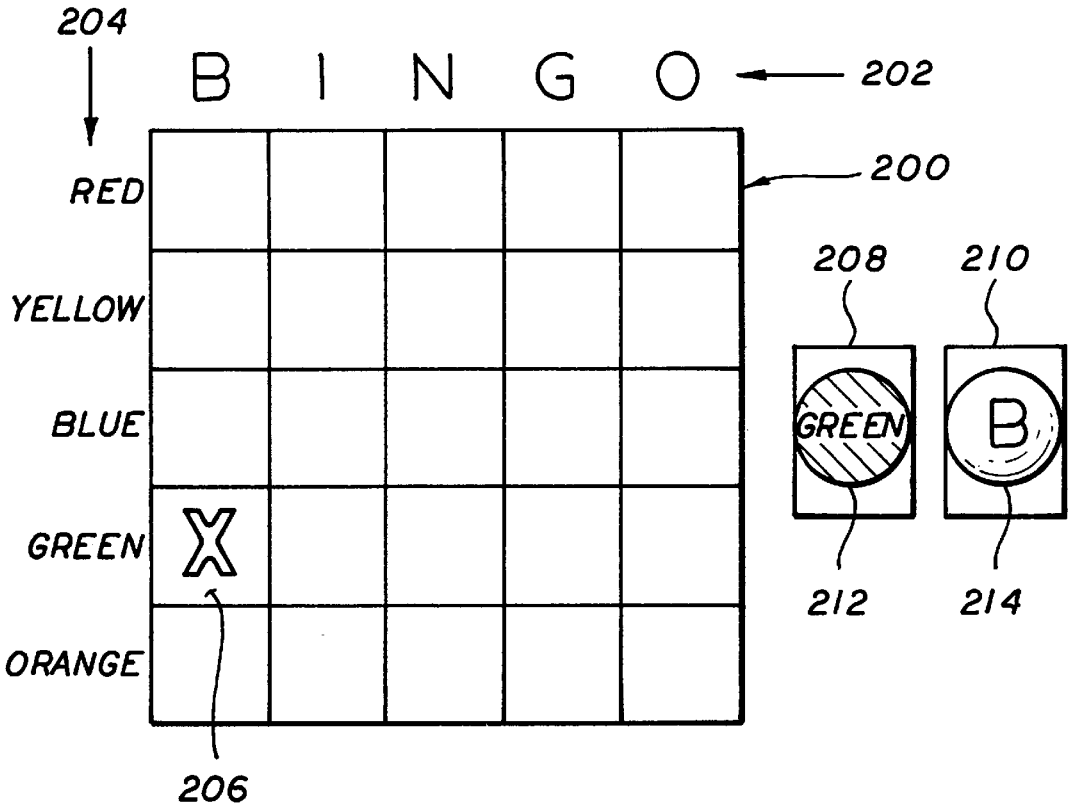
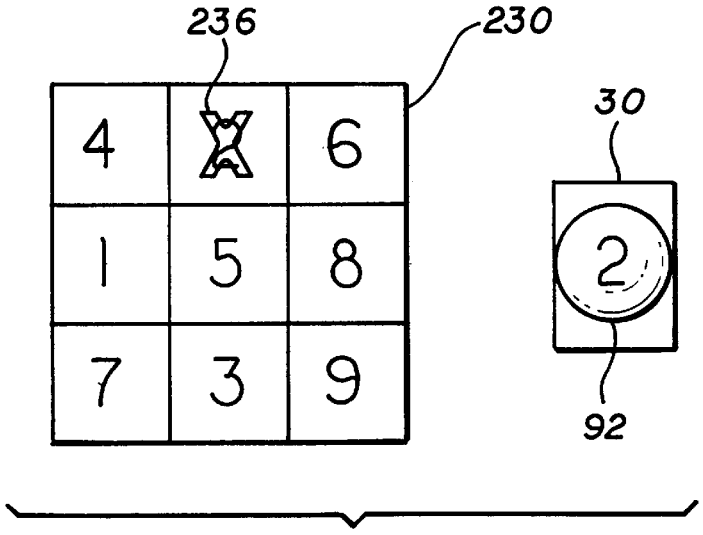
FIG. 9

GAMING DISPLAY DEVICE

CROSS REFERENCES TO RELATED APPLICATIONS

This application is a continuation-in-part of U.S. patent application Ser. No. 09/535,075, filed on Mar. 23, 2000 U.S. Pat. No. 6,338,678 which claims priority of and incorporates by reference U.S. provisional patent application No. 60/149,143, filed on Aug. 23, 1999, Ser. No. 60/151,257, filed on Aug. 27, 1999, and Ser. No. 60/178,047, filed on Jan. 24, 2000.

BACKGROUND OF THE INVENTION

1. Field of Invention

The present invention relates to a display device for use with a gaming device that selects one or more balls from a plurality of individually controlled balls and displays the selected ball.

2. Description of Related Art

Gaming Devices

Gaming devices are well known in the art and a large variety of gaming devices have been developed. In general, gaming devices allow users or players to play a game. In many casino-type gaming devices, the outcome of the game depends, at least in part, on a randomly generated event. For example, a gaming device may use a random number generator to generate a random or pseudo-random number. The random number may then be compared to a predefined table to determine the outcome of the event. If the random number falls within a certain range of numbers on the table, the player may win a predefined prize. The table may also contain display information that allows the gaming device to generate a display that corresponds to the outcome of the game. The gaming device may present the outcome of the game on a large variety of display devices, such as mechanical spinning reels or video screens.

Bonus Prizes

Some gaming devices award bonuses in addition to prizes that are awarded in the primary game. A bonus can be defined as an additional prize that is awarded to the player when a predefined event occurs. An example of a bonus game can be found in U.S. Pat. No. 5,848,932 issued to Adams. One of the gaming devices described in this document comprises three spinning reels and a spinning wheel bonus display. When predetermined indicia are displayed on the spinning reels of the primary game, the wheel can be activated to indicate a bonus prize. The bonus prize is awarded in addition to any prizes awarded in the primary game.

Generally, bonus prizes are offered in such games in order to increase the excitement and enjoyment experienced by players. This attracts more players to the game and encourages players to play longer. When gaming devices attract more players and the players play longer, they tend to be more commercially successful relative to other gaming devices.

Display Devices

In addition, highly visible display devices are utilized on gaming devices in order to attract players. Once players are attracted to the gaming device, they tend to play longer because the display device enhances the stimulation and excitement experienced by players. It is, therefore, desirable for gaming devices to incorporate highly visible display devices.

Display devices tend to be more successful if they are a derivation of a well-known game or theme. They are more successful because players tend to be drawn to games that they instantly recognize. Many players are reluctant to try completely new games because they must spend time to learn the new game. It is, therefore, desirable to provide display devices that are based on well-known games or themes.

Display devices also tend to be more successful if they utilize physical objects rather than simulations. Although video devices and electronic signs can be used for display devices, players are more attracted to display devices that utilize physical objects. Physical objects can be even more effective display devices if they are moveable and they are used in combination with lights and sounds.

Keno

Upon an initial examination, it would appear that the display device of Keno is an excellent choice for a display device for gaming devices. Keno is well known to the playing public, and it utilizes a highly visible and attractive display device. The display device comprises a container with a plurality of numbered balls. The balls in the container are agitated or jumbled, usually by a jet of air, to a state where they ricochet off of the walls of the container.

In the game of Keno, players select numbers that may be drawn from the Keno display device. The display device jumbles or mixes numbered balls in the container and then draws a predetermined number of balls from the container. Players are paid based on the number of balls drawn from the display device that match the numbers they selected.

However, before the present invention, the Keno display device has been unsuitable for use with gaming devices. One of the reasons this is so is because Keno is susceptible to environmental influences. An important aspect of any gaming device is resistance to environmental influences that could affect the results of the game. However, as the balls are jumbled in the Keno ball device, static electricity, dust, and contaminants build up on the balls. This may cause the balls to stick to each other or to components in the display device thereby influencing the randomness of the game. Furthermore, the balls used in Keno displays may have slightly different weights or sizes that subtly affects the outcome of the game.

Another reason the game of Keno has been unsuitable as an indicator for a gaming device is that it requires a great deal of human involvement. In many Keno games, human operators are required to read the numbers of the Keno balls as they are selected and input the numbers into a computer or display. Furthermore, operators must regularly clean the Keno balls and the Keno devices to keep dust and contaminants from building up on the balls. Not only does this require far too much human involvement for an automated gaming device (the greater the human involvement, the greater the cost of operating the game), the game is also susceptible to tampering and cheating.

Because of its susceptibility to environmental influences and tampering and its dependence on human operators and maintenance personnel, Keno games are not allowed in at least one major gaming jurisdiction. Furthermore, these disadvantages have prevented Keno display devices and other devices that use jumbled balls from being adapted for use with gaming devices. What has long been needed is a means for adapting jumbled ball display devices for use with gaming devices. Although reference is made to the game of Keno, it is to be understood that the present invention may be used with almost any type of ball or jumbled ball display device, such as lottery balls.

Jumbled Ball Displays

Two references that have attempted to utilize jumbled ball displays are U.S. Pat. No. 4,871,171 issued to Rivero and U.S. Pat. No. 5,380,007 issued to Travis et al. Rivero appears to disclose a game device with means for simulating the release of a ball. In this reference, a rotating drum 2 is provided with numbered balls 17. As the drum rotates, a ball is released into a transparent tube 16.

However, Rivero is not intended to show the player the ball that is released from the drum. Rather, the ball is held in the tube, out of view of the player, and an electronic simulation of the ball number is presented in a window 9. This is intended to give the player "the impression" that the ball has been counted. Rivero fails to disclose or suggest displaying actual balls to the player to indicate the outcome of the game or the value of a prize.

Travis et al. appears to disclose a video lottery gaming device with numbered balls 48. However, all of the balls are simulations generated by software and no physical balls are displayed to the player. Travis et al. also fails to disclose or suggest displaying actual balls to the player to indicate the outcome of the game or the value of a prize.

One of the disadvantages with Rivero and Travis et al. is that no actual physical balls are used to display the outcome of a game. This is less desirable because players like to see physical objects rather than electronic simulations of the physical objects. Moreover, players tend to believe that a game device is misleading when the device purports to display a simulation of an object rather than the object itself. This is especially true when the object itself is supposedly available for viewing, as is the case in Rivero.

SUMMARY OF INVENTION

1. Advantages of the Invention

One of the advantages of the present invention is that it provides a gaming device that utilizes a highly visible display device.

A further advantage of the present invention is that it provides a display device that may be used with a primary game or a bonus game.

Another advantage of the present invention is that it provides a display device that utilizes physical objects.

An additional advantage of the present invention is that it utilizes a jumbled ball display device that is similar to the well-known game of Keno and other games that utilize jumbled balls.

Another advantage of the present invention is that it provides a display device that eliminates environmental influences on the outcome of the game.

A further advantage of the present invention is that it provides a display device that reduces the risk of tampering.

Another advantage of the present invention is that it provides a display device that requires no human operators.

Yet another advantage of the present invention is that it provides a display device that requires little maintenance.

These and other advantages of the present invention may be realized by reference to other portions of the specification, claims, and abstract.

2. Brief Description of the Invention

The present invention comprises a display device for use with a gaming device. The display device may comprise a plurality of prize balls, a ball holder, a controller, a display mechanism, and a positioning mechanism. The ball holder is adapted to hold the prize balls in an individually controlled manner. The controller is adapted to select a ball in the holder and to control the positioning mechanism. The display mechanism is adapted to display the selected ball to the player. The positioning mechanism is in communication with the controller and it is adapted to position the selected ball relative to the display mechanism, whereby the display mechanism may display the selected ball. The display device may be used with a jumbled ball display and a game apparatus.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

Preferred embodiments of the present invention are shown in the accompanying drawings wherein:

FIG. 1A is substantially a front view of the gaming device of the present invention.

FIG. 1B is substantially a side view of an alternative embodiment of the gaming device of the present invention.

FIG. 3 is substantially a top cross sectional view of the preferred ball holder of the present invention taken along line III in FIG. 2.

FIG. 4 is substantially a top cross sectional view of an alternative ball holder of the present invention.

FIG. 6 is substantially a schematic diagram of an alternative embodiment of the present invention using multiple stacked ball holders.

FIG. 7 is substantially an alternative display mechanism of the present invention.

FIG. 8 is substantially a schematic representation of a bingo game that may be used with the present invention.

FIG. 9 is substantially a schematic representation of an alternative bingo game that may be used with the present invention.

DESCRIPTION OF THE PREFERRED EMBODIMENT

Figure 1C:
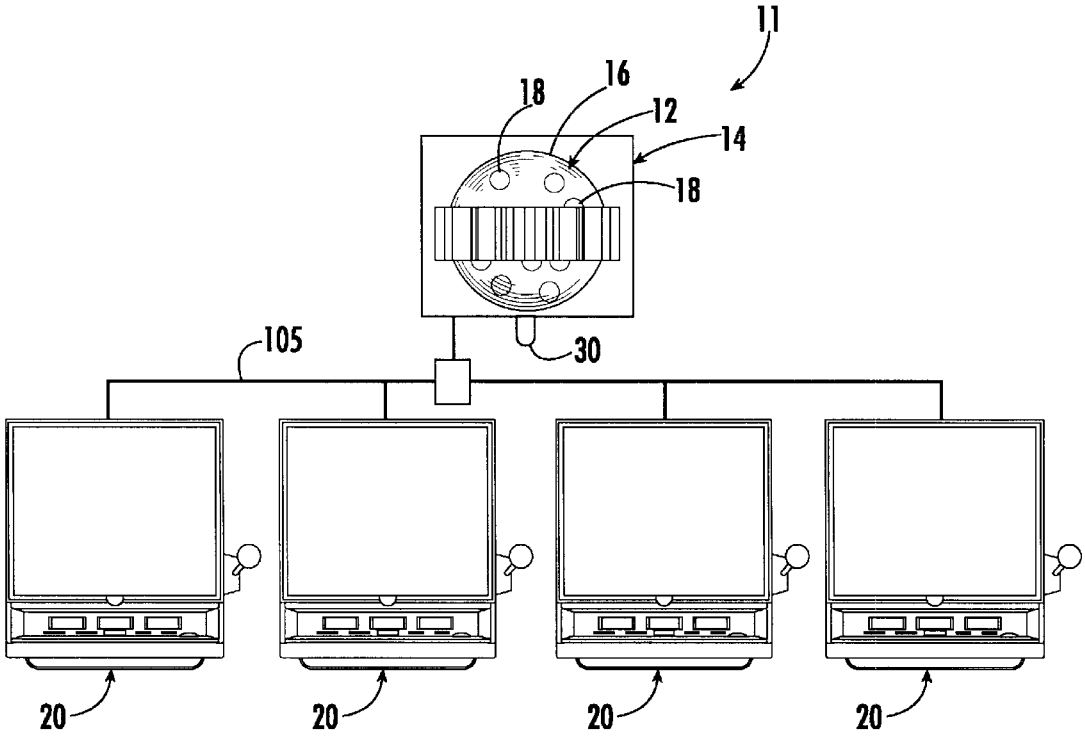
FIG. 1C is substantially a top schematic diagram of the display device of the present invention in use with a plurality of display apparatus.

As seen in FIG. 1A, the present invention comprises a gaming device, generally indicated by reference number 10.

Gaming device 10 comprises a display device 11 and a game apparatus 20. Display device 11 may comprise a jumbled ball display 12 and a prize display 14.

Game Apparatus

With continuing reference to FIG. 1A, game apparatus 20 may be any of a large number of devices that are adapted to allow players to play a game. For example, game apparatus 20 may utilize spinning reels 22–24 or a video display (not shown) to display outcomes of the game. Means may also be provided for accepting wagers, such as a coin slot 21 or card reader 25, and for awarding prizes, such as a coin dispenser 27. A handle 26 and button 28 are provided for activating game apparatus 20 to begin a game. In at least one preferred embodiment, game apparatus 20 may be an S Plus model gaming device manufactured by International Game Technology in Reno, Nev.

Game apparatus 20 is preferably controlled by an electronic controller 82 (see FIG. 2) that utilizes a random number generator. The random number generator produces a random or pseudo random number for each game. The outcome of the game may be determined by comparing the random number to a table of outcomes stored in a memory and accessed by controller 82. A number of different tables of outcomes may be used and different tables may be used for different games. The tables can be designed so that different prizes have different probabilities of being awarded. Such design techniques are well known in gaming. Examples of such designs are shown in U.S. Pat No. 4,448,419, issued to Telnaes, and U.S. Pat. No. 5,456,465, issued to Durham. Controller 82 causes spinning reels 22–24 of the video display to show the outcome of the game that corresponds to the outcome of the random number generator. It is recognized that game apparatus 20 may operate in many other ways and still achieve the objects of the present invention.

Game apparatus 20 may also be capable of producing a bonus-activating event. This event may be many different types of events. For example, a bonus-activating event may comprise displaying a particular symbol, such as a "bonus" symbol, or combination of symbols, such as three "7" symbols, on reels 22–24. If the game being played is poker based, the bonus-activating event may be occurrence of a certain hand, such as a royal flush. Furthermore, a bonus-activating event may occur when a player accumulates a number of symbols or game outcomes over a number of separate game plays. For example, a bonus-activating event may occur when the player receives three "bonus" symbols during a period of time. The bonus-activating event may be based on an external event. For example, a bonus-activating event may occur when a group of players obtain a certain result.

Jumbled Ball Display

With continuing reference to FIG. 1A, jumbled ball display 12 comprises a container 16 that is adapted to hold a plurality of display balls 18. Container 16 is at least partially transparent allowing players to view display balls 18 inside of the container. Container 16 is made of a transparent material, such as plastic or glass. In the preferred embodiment, container 16 is made of acrylic. Suitable containers of this type may be obtained from Tripp Plastics of Reno, Nev. However, container 16 may also be a wire cage of a type that is used in some Keno games.

Container 16 may have many different shapes, such as a sphere, cube, cylinder, triangle, etc. In the preferred embodiment, container 16 is substantially spherical with a partially flat back (not shown). The flat back allows container 16 to be large while still allowing gaming device 10 to placed against a wall, another gaming device, or other objects.

Although display balls 18 are preferably similar to Keno balls, many other types of balls may be used. For example, display balls 18 may be ping pong balls or rubber balls. Display 12 also comprises, an agitator (not shown in FIG. 1) to agitate or jumble display balls 18 within container 16. The agitator maybe a stream of air or a mechanical mixing device. The agitator causes the balls to bounce and ricochet off of the walls of container 16. In the preferred embodiment, a stream of air is used as an agitator and container 16 comprises an off center opening for the stream of air. The opening is off center to increase the initial agitation of display balls 18.

Fins (not shown) may also be provided at the bottom of container 16 to help agitate display balls 18. The fins support display balls 18 when they are resting at the bottom of container 16. This helps air circulate underneath display balls 18 to lift and separate the balls.

The purpose of jumbled ball display 12 is to attract and entertain players. When display balls 18 are agitated, they produce a vivid display that attracts the attention of people nearby and provides an exciting display for players playing gaming device 10. Display Balls 18 are preferably kept separate from balls used in display device 14.

FIG. 1B represents an alternative embodiment of the present invention in which two gaming devices 10 are placed back to back. Each gaming device 10 comprises a game apparatus 20. Game apparatuses 20, shown in FIG. 1B is known as a "slant top" for their sloping upper surfaces. However, other types of gaming devices, such as the upright game apparatus 20 shown in FIG. 1A, may also be used.

In this embodiment, a separate jumbled ball display 12 is provided for each game apparatus 20. Each jumbled ball display 12 may comprise container 16 in the shape of a hemisphere. Containers 16 may be placed back to back so that the two containers have a spherical appearance when viewed from the side. Other shapes, such as cubes and cylinders, may also be used. A mirror may be placed at the back of each container 16 to enhance the appearance of the jumbled ball displays 12 by reflecting images of jumbled display balls 18 outward toward the players. Containers 16 may also be one single container that is divided in two by a mirror or other partition. Each container 16 has its own independently operated agitator and jumbled display balls 18. Each game apparatus 20 has its own independently operated prize display 14 with display window 30.

Prize Display

Referring to FIGS. 1A and 1B, prize display 14 is adapted to select a prize ball and display the ball to a player. When a bonus-activating event occurs, prize display 14 senses this, selects a prize ball, and displays the ball in a display window 30.

Turning now to FIG. 2, prize display 14 comprises a controller 76 that is adapted to control the operation of the device. Controller 76 may be one or more computers or processor boards. For example, in the presently implemented embodiment, controller 76 comprises a bonus controller and stepper motor controller, which may be manufactured by Progressive Solutions in Carmichael, Calif., a core module by Z-World in Davis, Calif., and a sound board by Cleverdevices in Syosset, N.Y. Other, equally suitable devices may be purchased from other manufacturers. It is recognized that controller 76 may be a single processor or processor board. Furthermore, it is also recognized that controller 76 and controller 82 may be combined in a single processor or processor board.

Controller 76 is adapted to detect when a bonus activating event occurs in game apparatus 20. This may be accomplished by game apparatus controller 82 transmitting a signal to controller 76 that a bonus event has occurred. For example, controller 82 may determine the outcome of each game and when a bonus-activating outcome occurs, it transmits a signal to controller 76. Alternatively, controller 76 may periodically interrogate controller 82. In another embodiment, one or more sensors may be provided for determining if a bonus activating event has occurred. For example, sensors 84–86 may sense the positions of reels 22–24. When reels 22–24 are in a bonus activating position, controller 76 would sense this position and begin a bonus sequence (described below). Sensors may also be provided external to gaming device 10 to detect external bonus-activating events.

Controller 82 may also transmit a variety of information to controller 76. For example, controller 82 may signal when coins or currency have been inserted, when a game starts, when an error has occurred, and when a sensor detects tampering.

When controller 76 detects a bonus-activating event, it may begin a bonus sequence by activating display 110. Display 110 may comprise many different kinds of display devices, such as video screens, lights, light emitting diodes, etc. Display 110 may comprise its own controller that is adapted to generate a variety of displays.

Display 110 may indicate that a player has qualified for a bonus round and prompt the player to perform an action. In the preferred embodiment, the player is prompted to activate the bonus sequence by pressing input device 90. Input device 90 may be a simple button, a keyboard, or a touch screen display. In the embodiment in which the player must accumulate a number of bonus symbols to qualify for a bonus, display 110 may indicate the number of symbols the player has received.

When controller 76 detects input device 90 being activated, the controller would activate the agitator in jumbled ball display 12. In the preferred embodiment, the agitator comprises blower 50, which blows air into container 16. Alternatively, the agitator may begin automatically and input device 90 may be used to initiate the display sequence. In another embodiment, controller 76 may wait a predetermined time period for the player to activate input device 90. If the player does not activate input device 90 in that time period, controller 76 would automatically activate the display 12 and initiate the display sequence. In yet another embodiment, controller 76 automatically initiates the display sequence in a predetermined time period, independent from input device 90, and input device 90 is only used to activate the jumbled ball display 12. Of course, no input device may be used and controller 76 may automatically activate display 12 and begin the display sequence.

To display a prize ball, controller 76 performs a routine to determine which ball will be displayed. This may be performed by a number of methods that are well known in the art. For example, prize balls 92 may be sequentially displayed or displayed based on external events, such as certain bonus activating events may always cause the same prize ball to be displayed.

In the preferred embodiment, however, prize balls 92 are randomly selected. Controller 76 generates a random number and then compares the random number to a pay table similar to that described for game apparatus 20 or as described in U.S. Pat No. 5,823,874, issued to Adams. A simple pay table may appear as follows:

| Random Number | Prize Ball Number | Amount Paid |
|---|---|---|
| 0.00 to 0.50 | 1 | $1.00 |
| 0.51 to 0.75 | 2 | $5.00 |
| 0.76 to 0.95 | 3 | × 2 |
| 0.96 to 1.00 | 4 | $1,000.00 |

For example, if the random number generator produced 0.65, prize ball number 2 would be displayed and $5.00 would be awarded to the player. If the random number generator produced 0.80, prize ball number 3 would be displayed. Prize ball number 3 is a multiplier ball that multiplies some amount produced by game apparatus 20. Gaming apparatus 20, for instance, may award $20 and the multiplier ball would multiply this by two, awarding the player $40.

The present invention is not limited to the example pay table shown. A greater number of prize balls may be used and, as will be discussed below, a combination of prize balls may be displayed. Furthermore, different kinds of prizes, besides monetary prizes, may be awarded. For example, the prizes may be goods, services, or additional games. The goods and services may be awarded in the form of physical objects, tickets, vouchers, coupons, etc. Additional games may be presented in the form of tickets, such as scratch off lottery tickets. In the embodiments in which tickets, vouchers, and coupons are used, the objects are dispensed using an internally or externally mounted dispenser 111. Such dispensers are well known in the art.

Once controller 76 determines the prize ball to be displayed and the prize to be awarded, the controller activates a positioning mechanism 77. Positioning mechanism 77 is adapted to position a selected prize ball (that is separate from display balls 18) so that it can be displayed. Positioning mechanism 77 may utilize a large variety of devices to achieve its purpose. In the preferred embodiment, all of the prize balls are held in a ball holder 58. Ball holder 58 may be made from a variety of materials, such as plastics, metals, or composites. In one embodiment, ball holder 58 is cast high-density urethane foam that is machined to obtain a precise shape. In the preferred embodiment, ball holder 58 is injection molded plastic.

Prize balls 92 preferably have a similar appearance to display balls 18 in container 16. This creates the illusion that balls displayed in display window 30 originate from container 16. At least one of prize balls 92 have a symbol that is capable of indicating a prize to be awarded to the player.

Prize balls 92 are stored in ball holder 58 in an individually controlled manner so that individual balls can be selectively removed from the ball holder. This allows particular balls with particular symbols or values to be individually manipulated and displayed when desired. This may be accomplished in different ways. In the preferred embodiment, ball holder 58 comprises a chamber 62 for each prize ball 92 stored in the holder. A display mechanism 29 is provided for removing ball 92 stored in chamber 62, displaying the ball, and replacing it in the chamber.

In the preferred embodiment, ball holder 58 is cylindrical as illustrated in FIG. 3. Chambers 62 are positioned outward from a central axis 59 of ball holder 58, near the periphery of the holder. Thus, chambers 62 may be positioned by rotating ball holder 58 around its central axis 59.

Ball holder 58 may be provided in different configurations. For example, as shown in FIG. 4, ball holder 61 may be square or rectangular with chambers 62 arranged in rows and columns. In this embodiment, controller 76 is programmed with the location of chambers 62 and ball holder 61 is positioned by moving it laterally and longitudinally. Stepper motors and gears may perform the lateral and longitudinal positioning (not shown).

Returning to FIG. 2, positioning mechanism 77 comprises a stepper motor 60 for rotating holder 58. Wheel 74, rigidly attached to holder 58, and sensor 83, not attached to the holder, are provided for determining the angular position of the holder. Thus, controller 76 can position a ball 92 in holder 58 where it can be removed and replaced by rotating the holder and monitoring its angular position. The angular position of each prize ball 92 is stored in memory in controller 76. Sensor 83 may be an infrared source and detector and the periphery of wheel 74 may comprise portions with different reflective characteristics, such as physical holes or gaps or absorbent paint lines. Alternatively, an optical flag configuration similar to that described in U.S. Pat. No. 4,911,449, issued to Bertram, may be used.

Figure 2A:
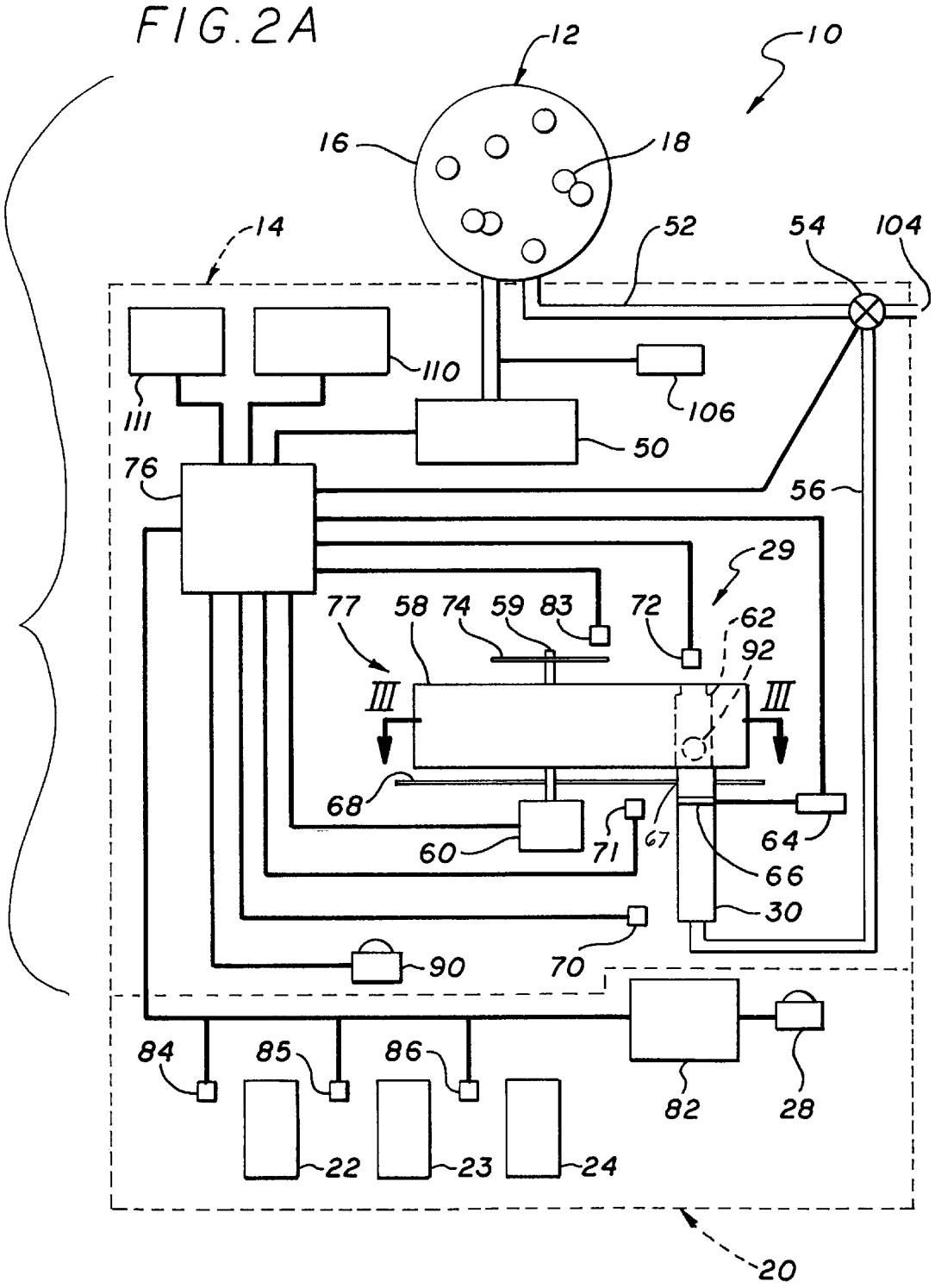
FIG. 2A is substantially a schematic diagram of the gaming device of the present invention.
Figure 5A:
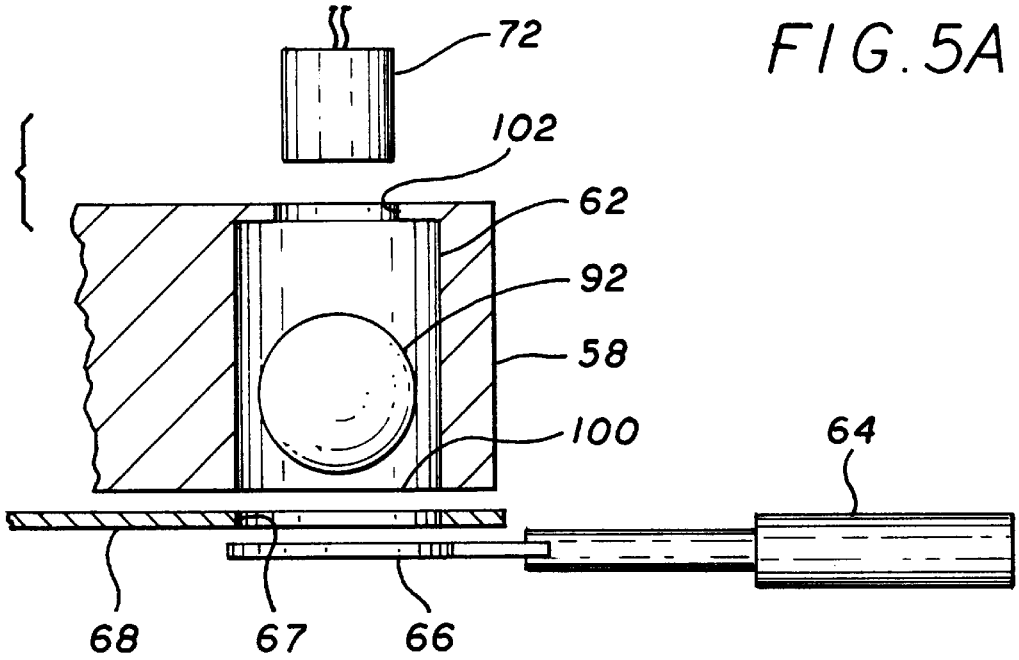
FIG. 5A is substantially an enlarged view of the ball holder shown in FIG. 2.

In the preferred embodiment, holder 58 is arranged to allow the force of gravity to remove balls 92 from the holder. Referring now to FIGS. 2A and 5A, each chamber 62 has a lower opening 100 that is large enough for prize ball 92 to pass through. A plate 68 is provided on the lower surface of holder 58 for preventing prize balls 92 from falling out of chambers 62. A hole 67 is provided in one portion of plate 68 for allowing ball 92 to pass through the plate. A gate 66 blocks ball 92 until it is opened by an actuator 64. Gate 66 may cover the entire hole 67 or just a portion of it and it may be operated in a sliding or hinged manner. Actuator 64 may be an electrical solenoid actuator.

Figure 5B:
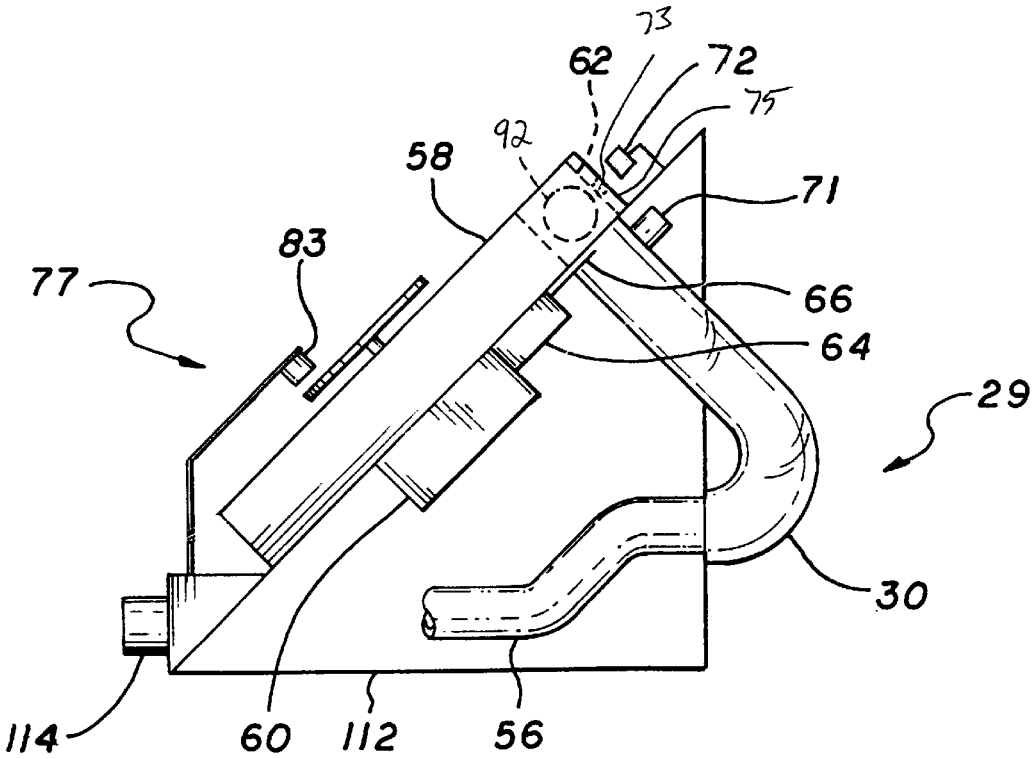
FIG. 5B is substantially a side elevational view of the positioning and display mechanisms of the preferred embodiment of the present invention.

FIG. 5B represents a preferred embodiment in which a chassis 112 supports ball holder 58 at approximately a forty-five degree angle to the vertical. Mounting grooves (not shown) may be provided in prize display 14 for slidably receiving chassis 112 and connector 114 may be provided for connecting electrical circuits and devices to power supplies and controller 76. One of the advantages of this embodiment is that positioning mechanism 77 and display mechanism 29 can be easily serviced by removing chassis 112 from prize display device 14.

Referring to FIGS. 2A and 5A, in normal operation, after controller 76 has determined which ball is to be displayed, the controller rotates holder 58 until the desired prize ball 92 is positioned over the plate hole 67. At the appropriate time, controller 76 activates actuator 64 to open gate 66. The force of gravity then pulls prize ball 92 downward through hole 67 into display window 30. Display window 30 may be a chamber with a transparent or partially transparent wall that allows the player to see selected prize ball 92. In the preferred embodiment, display window 30 comprises a tube that projects outward from the front surface of prize display device 14. This allows players to view prize ball 92 from many different angles and see symbols on the ball. Sensors 70 and/or 71 may be used to verify that prize ball 92 has fallen into display window 30. If sensors 70 and/or 71 do not detect ball 92 in its proper position, controller 76 may enter an error mode.

If the ball is detected in its proper position, controller 76 may cause display 110 to display the prize, if any, that the player has won. Other effects may also be presented, such as pre-recorded sound from speakers. If the actual prize is money, the amount of the prize may be added to the player's credit meter or the prize may be dispensed from dispenser 111 or coin dispenser 27.

After ball 92 has been displayed long enough, controller 76 operates a valve 54 to divert exhaust air from container 16. While blower 50 is in operation, air is allowed to escape container 16 through an exhaust duct 52. Valve 54 is used to divert air from a vent 104 to a display duct 56. Display duct 56 directs air to the bottom of display window 30 where it blows the ball 92 upwards back into chamber 62. An upper opening 102 is provided in chamber 62 for allowing air to escape from the chamber thereby producing an air current. Sensors 72 and/or 71 may be used to verify that ball 92 has returned to chamber 62. If the ball is not detected in its proper position, controller 76 may enter an error mode and an attendant is called. In the preferred embodiment, shown in FIG. 5B, sensor 72 is placed next to the peripheral wall 75 of ball holder 58 and a hole 73 is provided in the peripheral wall next to each chamber 62.

It is recognized that the components of the present invention maybe arranged alternatively so that ball display window 30 is located above holder 58 and ball 92 is blown upwards into the display. When valve 54 is closed, the force of gravity pulls ball 92 back into chamber 62. In this alternate embodiment, once ball 92 has returned to chamber 62, controller 76 closes gate 66 by activating actuator 64, turns off blower 50, and waits for the next activating event.

A power failure or power surge could cause actuator 64 to malfunction and improperly open gate 66 while prize display 14 is idle. This would cause prize ball 92 to fall out of chamber 92 into display window 30, thereby giving a false indication that the player had won a prize. In order to prevent this, in the preferred embodiment, at least one chamber 62 does not have prize ball 92 (see FIG. 3). This empty chamber is positioned over hole 67 whenever prize display 14 is idle.

Because some balls are very light, static electricity can cause the balls to stick to each other and to other components. To prevent this, a variety of static discharge devices 106 may be placed in various locations in the present invention. In the preferred embodiment, static discharge device 106 is a bare stranded copper wire with its strands spread out. The wire is placed in the flow of air between agitator 50 and container 16 and wire is attached to a common ground.

Prize display 14 of the present invention may also comprise means for simultaneously displaying a plurality of balls 92. To accomplish this, plate 68 may have multiple holes 67 (not shown), each with its own gate 66 and actuator 64, for supplying balls to multiple display windows. Thus, holder 58 may be positioned so that the appropriate ball is positioned over the appropriate hole 67 for supplying the appropriate display window 30. Alternatively, a plurality of ball holders 58 may be provided, each one supplying balls to a separate display window 30.

In yet another embodiment, seen in FIG. 6, a plurality of separately controlled ball holders 58 are arranged in a stack. Each ball holder 58 is rotated to a position so that chambers 62 are aligned above display window 30. Gates 66 are then opened and balls 92 are allowed to fall into display window 30. In this embodiment, display window 30 is large enough to display three balls simultaneously. When the display period has ended, balls 92 are blown back into chambers 62 and gates 66 are closed to separate and contain the balls. The action of gates 66 separates prize balls 92 into separate chambers 62.

With multiple balls being displayed, it is possible to use combinations of balls to indicate various bonus outcomes. It is also possible to replace the primary display of a gaming device with selector and prize display device 14. In other words, game apparatus 20 may be entirely replaced with selector and prize display device 14.

As seen in FIG. 7, the present invention comprises an alternative display mechanism 150. Display mechanism 150 comprises a cylindrical ball holder 152 that may be rotated around its central axis 158. Ball holder 152 comprises a plurality of chambers 154 positioned along the periphery of the holder, each chamber is adapted to hold ball 92. Unlike the embodiment described in FIGS. 2, it is not necessary to remove and replace balls 92 from chambers 154. Instead, at least a portion of the outer wall of each chamber 154 comprises a transparent material that allows players to view balls 92 inside the chamber. The transparent wall may comprise a ring of transparent material 156 that surrounds holder 152. A shutter device or door 164 may be provided between display window 30 and holder 152 for blocking the view of players while the holder is rotated. Although this embodiment has the advantage of a simpler mechanism, it may be less entertaining to players because it may be more apparent to the players that balls 92 do not originate from jumbled ball display 12.

As seen in FIG. 1C, a single display device 11 may also be used with a plurality of game apparatus 20. In this embodiment, each game apparatus is in communication with display device 11 by a communication device 105. Communication device 105 may be a network cable, such as an Ethernet cable, and appropriate hardware, such as network interface cards, may be included in display device 11 and game apparatus 20. When one of the game apparatus 20 produces a bonus-activating event, a signal is sent to display device 11. A prize ball may then be selected and displayed as described above.

Figure 2B:
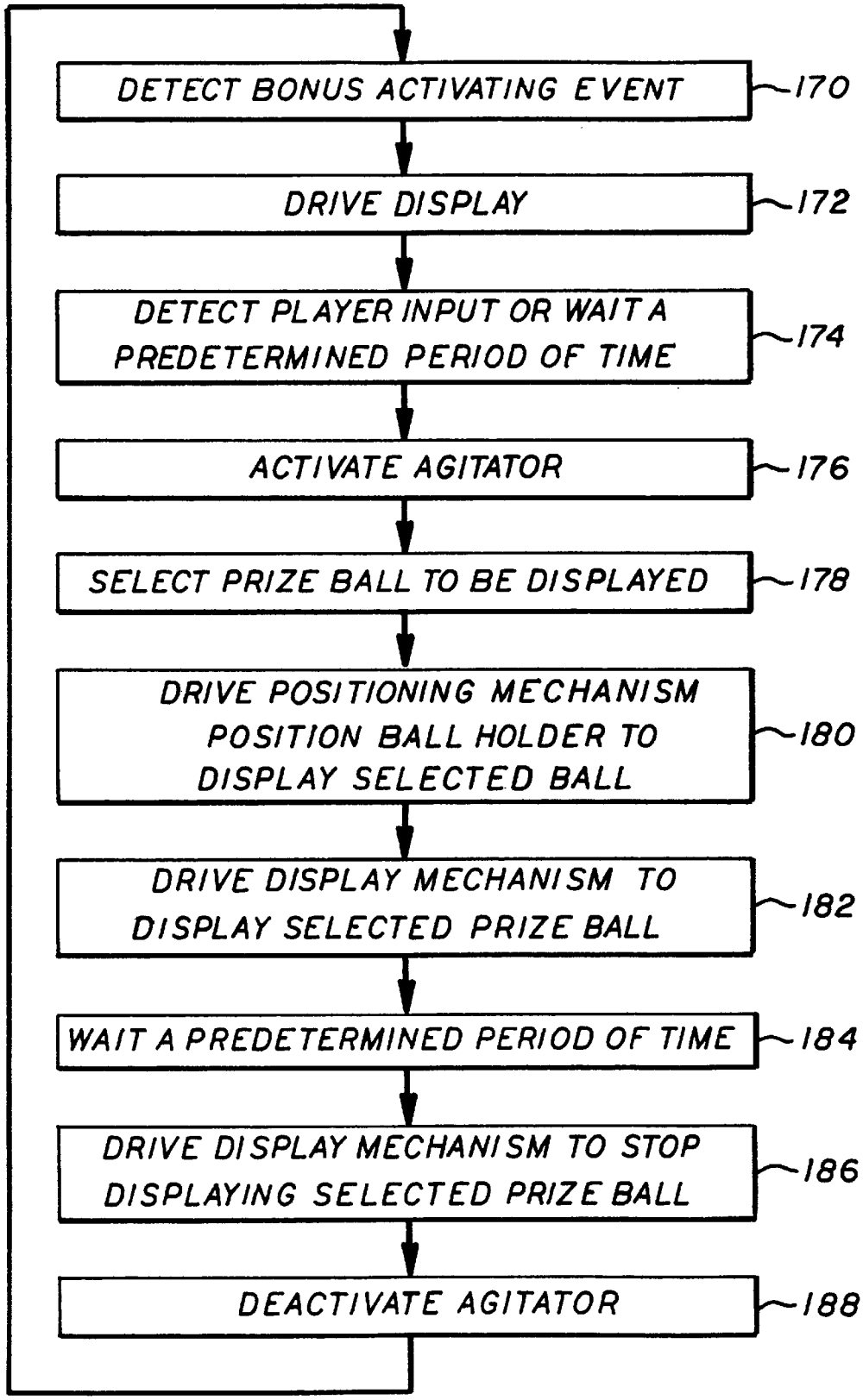
FIG. 2B is substantially a flow chart of the operation of the display device of the present invention.

Turning now to FIG. 2B, the operation of prize display 14 begins when controller 76 detects a bonus-activating event 170. Controller 76 may then drive display 110 to display an appropriate presentation or message 172. As discussed above, controller 76 may wait for player input from input device 90 or it may wait for a predetermined period of time 174. At some point, controller 76 activates the agitator 176 and selects a prize ball to be displayed 178 from ball holder 58. Controller 76 then drives positioning mechanism 77 to position ball holder 58 so that the selected prize ball may be displayed 180 and causes display mechanism 29 to display the selected ball 182. Controller 76 may then wait a predetermined period of time so that the player may see the displayed prize ball 184, after which it causes display mechanism 29 to stop displaying the selected prize ball 186. The agitator is then deactivated 188 and controller 76 returns to a monitoring state to detect the next bonus activating event 170.

Bingo

A number of games have been developed to take advantage of the unique features of the present invention. As seen in FIG. 8, one of the games of the present invention comprises a bingo card 200 that may be displayed by a display device, such as an LCD, LED, CRT, or backlit translucent material. The horizontal axis of the card may comprise alphabetic or numeric characters 202 and the vertical axis of the card may comprise colors 204. The alphanumeric characters and the colors may be randomly arranged for each new game, thereby adding variety to the game.

In the Bingo embodiment, prize display 14 comprises two display windows 208 and 210. Each display window 208 and 210 may have its own individual ball holder 58 and prize balls 92 (not shown in FIG. 8). Ball display 208 corresponds to the vertical axis with balls 212 therein displaying colors and ball display 210 corresponds to the horizontal axis with balls therein displaying alphabetic or numeric characters.

In this game, the player wins a bonus prize by filling all of the spaces in a row, column, diagonal line, or combination of rows, columns, and diagonal lines with a symbol. For example, when the player qualifies for a bonus award, prize display 14 may randomly select and display a green ball 212 and a ball 214 with the letter "B" on it. A symbol 206 may then be displayed in the space where the "B" column and the green row intersect. Play would continue in this way until the player wins a prize. Once a prize is won, card 200 may be cleared so that the bonus game may be replayed.

An alternative embodiment of the Bingo bonus game is disclosed in FIG. 9. In this embodiment, a bingo card 230 displays a plurality of symbols. The symbols may be randomly arranged on card 230 for each game. When display window 30 displays a ball 92, displaying a symbol thereon, a symbol 236, such as an "X," is placed on the corresponding space on bingo card 230.

Figure 10:
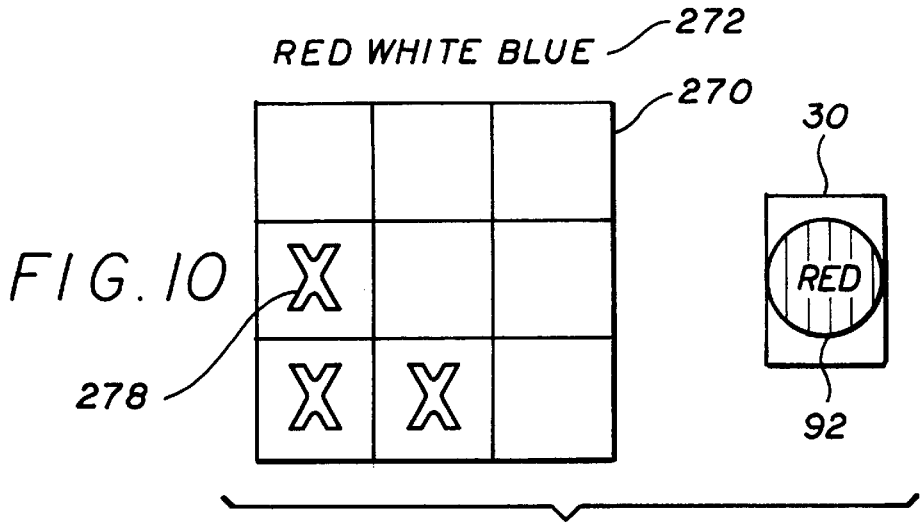
FIG. 10 is substantially a schematic representation of an alternative bingo game that may be used with the present invention.

In another embodiment, shown in FIG. 10, card 270 is divided into a plurality of columns. Each column corresponds with a particular type of symbol or color. The columns preferably have labels 272 on a horizontal axis. As prize display 14 displays a ball 92 in display window 30, a symbol 278 is placed in a space in the column that corresponds to the symbol on the ball. In this embodiment, the player is awarded a prize when all of the spaces in at least one column are filled. Card 270 is then cleared so that play can repeat.

Of course, many different variations of the Bingo bonus game may be utilized with the present invention. For example, larger or smaller cards and different symbols or combination of symbols may be used with the invention.

Lottery

Figure 11:
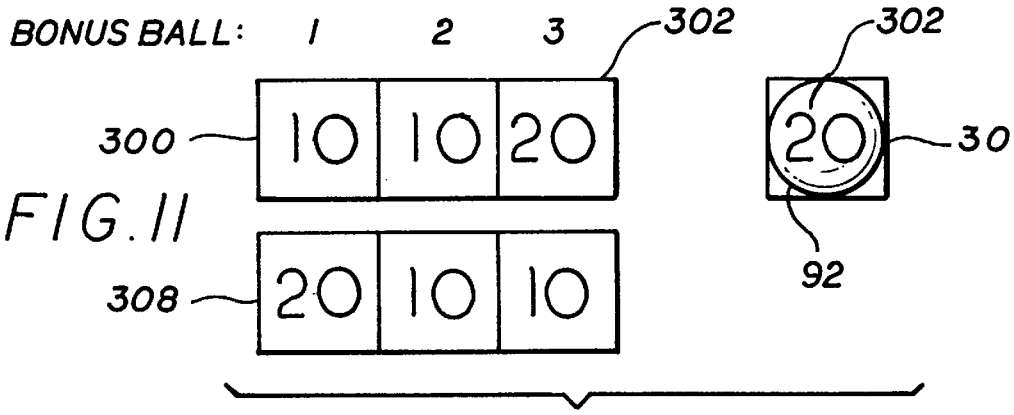
FIG. 11 is substantially a schematic representation of a lottery style game that may be used with the present invention.

The present invention also includes a game that follows a format similar to a lottery game. In this embodiment, seen in FIG. 11, prize ball 92 is selected and displayed in display window 30 in the same manner as other embodiments discussed above. Each time a ball is selected, a symbol 302 on the prize ball 92 is recorded in a first symbol display 300. In the example shown in FIG. 11, the number "10" has been recorded in the first and second areas for balls that have been previously selected and the number "20" is displayed in the third area for the most recent ball 92 selected. A second symbol display 308 is provided for displaying a randomly selected set of numbers. The numbers displayed in second display 308 may be generated with a random number generator that is adapted to select only the numbers that may be displayed on prize balls 92. Alternatively, similar to well known lottery games, the player may be allowed to pick the numbers in display 308. Of course, a greater or lesser number of spaces may be provided in displays 300 and 308.

In the preferred embodiment, the player is paid the amount shown on each prize ball 92 as it is displayed. Thus, in the example in FIG. 11, the player would be paid 20 credits or dollars for number 302 that is presented on the currently displayed ball 92. In addition to the prize displayed on ball 92, the player may qualify for an additional amount if the symbols displayed in first symbol display 300 are the same as the symbols displayed in second symbol display 308. In one embodiment, the symbols in first symbol display 300 must be in the same order as the symbols displayed in second symbol display 308. Thus, in the example shown in FIG. 11 the player would not win a prize because the order of the numbers are not the same. In another embodiment, the order of the numbers is irrelevant. Thus, in the example shown in FIG. 11 the player would win a prize because the symbols in first symbol display 300 are the same as the symbols in second symbol display 308. A modified version of the second embodiment would award a larger prize to the player if the order of the numbers in the two displays 300 and 308 were the same. In yet another embodiment, the prize that is awarded to a player is a progressive jackpot of a type that is well known in the art.

Player Selection

Figure 12:
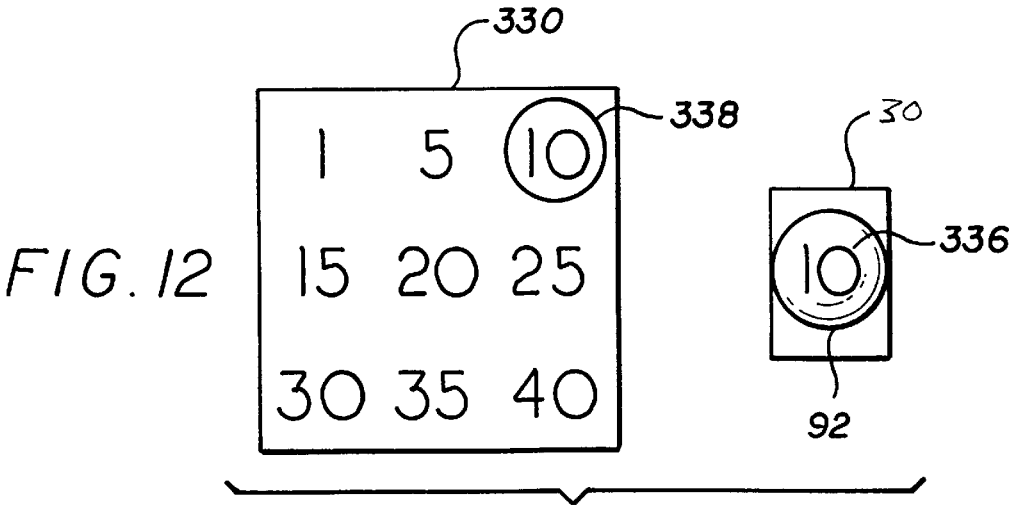
FIG. 12 is substantially a schematic representation of a player selection game that may be used with the present invention.

In another game of the present invention, the player selects a symbol or symbols from a list of symbols that the player may receive. Illustrated in FIG. 12, a display device 330 may be provided that displays a plurality of different symbols. When the game begins, the player may be prompted to select one of the possible symbols. In the case of a touch screen, the player may select the symbol by pressing the symbol with the player's finger. Other selection devices, such as buttons, may also be used. A graphical indicator may be used to indicate that the symbol has been selected, such as a circle 338 around the symbol. Once the symbol has been selected, the prize display 14 selects a prize ball and displays it in display window 30. If a symbol 336 on ball 92 matches the symbol selected by the player, the player is awarded a prize. In an alternative embodiment, the player is awarded the prize shown on the ball and the player receives an additional prize if the symbol on the ball matches the symbol selected by the player.

The player selection embodiment of the present invention may be combined with the lottery embodiment of the present invention. In this combination, the player is asked to select a plurality of numbers. If the symbols on the balls selected by prize display 14 are the same as the symbols selected by the player, the player is awarded a prize.

One of the advantages of providing the games discussed above is to increase the excitement and enjoyment of playing gaming device 10. Not only are the games entertaining to view, but they also increase the excitement and enjoyment experienced by players by offering large prizes. Each of the games can be adapted to award large prizes because they are capable of producing low probability events from which the large prizes are awarded.

In addition, the games of the present invention may be adapted for use as the primary game. Thus, game apparatus 20 may be completely replaced with the games of the present invention.

Video Display Embodiment

Figure 13:
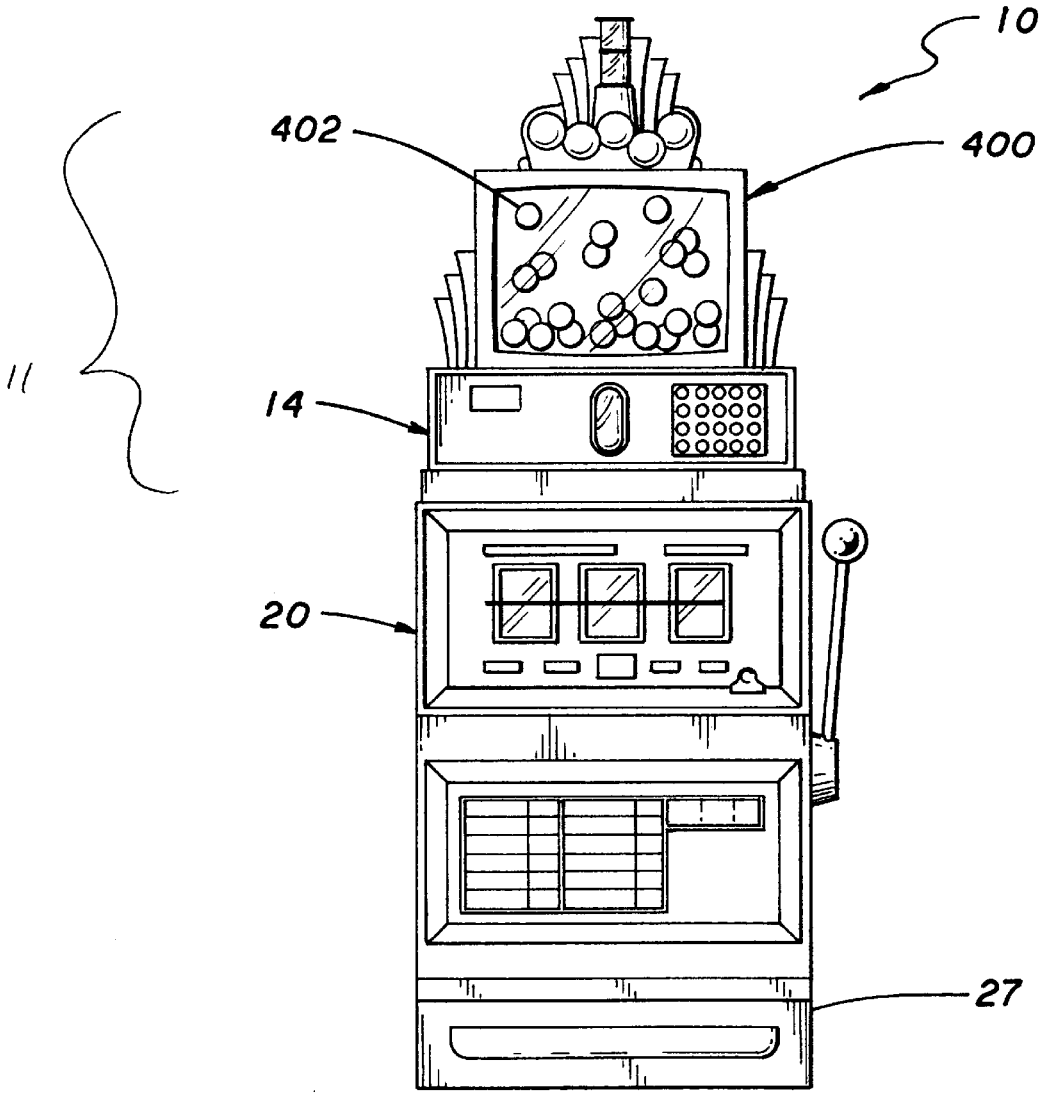
FIG. 13 is substantially a front view of the gaming device of the present invention utilizing a video display device.

As seen in FIG. 13, the present invention comprises an alternative embodiment that utilizes a video display device. In this embodiment, jumbled ball display 12 (see FIG. 1) is replaced by video display device 400. Video display device 400 presents an image of display balls 402 that is shown to the player. Video display device 400 may be any of a large number of display devices that are well known in the art. For example, video display device 400 may be a cathode ray tube of a type that is used with many personal computers.

Video display device 400 is in communication with controller 76 (see FIG. 2A). Controller 76 transmits messages to video display device 400 to request the display device to produce different displays. For example, controller 76 may send a signal to video display device 400 when a bonus activating event has occurred to show balls 402 in an agitated state. After a bonus ball is selected and displayed, controller 76 may send another signal to video display device 400 to show the balls returning to a resting state.

Video display device 400 may comprise a video controller (not shown) that drives the display device to present various displays. Many different well-known video controllers may be used. Software and data used to produce different presentations may be stored on the video controller in non-volatile memory, such as compact disks, magnetic disk drives, or erasable programmable read only memory (EPROM).

Of course, video display device 400 may display other information in graphic and text form, such as instructions on how to use gaming device 10. Speakers may also be provided for presenting audio information, such as the sound of agitated balls or music when a prize is won.

This embodiment has the advantage of reducing maintenance because the moving parts of the jumbled ball display are eliminated. This embodiment also provides greater flexibility because many different kinds of presentations may be displayed on the video display device 400.

Gaming device 10 disclosed in FIG. 13 utilizes video display device 400 in place of jumbled ball display 12, but prize display 14 is provided to select and display physical prize balls, which may be adapted to appear to originate from the video display device. However, it is recognized that video display device 400 may be used in place of prize display 14 as well. In this embodiment, video display device 400 could display a prize ball that appears to be randomly selected from the agitated display balls.

Conclusion

It can now be seen that the present invention solves many of the problems associated with the prior art. The present invention provides a gaming device that utilizes a highly visible display device that may be used with a primary game or a bonus game. The present invention provides a display device that utilizes physical objects in the form of a jumbled ball display device that is similar to the well-known game of Keno and other games that utilize jumbled balls. The present invention provides a display device that eliminates environmental influences on the outcome of the game. The present invention provides a display device that reduces the risk of tampering, requires no human operators, and requires little maintenance.

Although the description above contains many specifications, these should not be construed as limiting the scope of the invention but as merely providing illustrations of some of the presently preferred embodiments of this invention. The specification, for instance, makes reference to bonus prizes. However, the present invention is not intended to be limited to bonus prizes. Rather it is intended that the present invention can be used independently as a stand-alone game. Thus, the scope of the invention should be determined by the appended claims and their legal equivalents rather than by the examples given.

What is claimed is:

1. A gaming device, the gaming device comprising:

(A) a game apparatus, the game apparatus being adapted to allow a player to play a game;

(B) a plurality of display balls;

(C) at least one container, the container being adapted to hold the display balls, the container having at least one portion that is at least partially transparent, wherein the player may view the balls in the container;

(D) at least one agitator, the agitator being adapted to agitate the display balls inside of the container;

(E) a plurality of prize balls;

(F) at least one ball holder, the ball holder being adapted to hold the prize balls in an individually controlled manner;

(G) a controller in communication with the game apparatus, the controller being adapted to select at least one prize ball only from the ball holder, none of the display balls being selected; and (H) a display mechanism in communication with the controller, the display mechanism being adapted to display the selected prize ball to the player.

2. The gaming device of claim 1 further comprising a positioning mechanism in communication with the controller and attached to the ball holder, the positioning mechanism being adapted to position the selected prize ball relative to the display mechanism, whereby the display mechanism may display the selected ball.

3. The gaming device of claim 1 wherein the game apparatus is adapted to produce a bonus activating event.

4. The gaming device of claim 1 wherein the controller is adapted to detect a bonus activating event.

5. The gaming device of claim 4 wherein the bonus-activating event is at least one predetermined outcome of the game apparatus.

6. The gaming device of claim 4 wherein the controller is further adapted to activate the agitator after the controller detects a bonus-activating event.

7. The gaming device of claim 1 further comprising an input device in communication with the controller, the input device being adapted to enable the controller to cause the display the selected prize ball when the player activates the input device.

8. The gaming device of claim 7 wherein the controller is adapted to detect a bonus activating event, wherein the input device is enabled after the controller has detected a bonus activating event.

9. The gaming device of claim 8 wherein the controller automatically causes the display of the selected prize ball if the player does not activate the input device within a predetermined time period after a bonus-activating event has been detected by the controller.

10. The gaming device of claim 1 wherein the selected prize ball displayed by the display mechanism determines a prize to be awarded to the player.

11. The gaming device of claim 1 wherein the game apparatus is further adapted to award a prize, wherein the ball displayed by the display mechanism determines a bonus prize to be awarded to the player in addition to the prize awarded by the game apparatus.

12. The gaming device of claim 1 wherein the game apparatus is further adapted to award a prize and the ball displayed by the display mechanism determines a multiplier, the player being awarded a multiple of the prize awarded by the game apparatus.

13. A display device for playing a game, the gaming device comprising:

(A) a plurality of display balls;

(B) at least one container, the container being adapted to hold the display balls, the container comprising a wall, at least a portion of the wall being at least partially transparent;

(C) at least one agitator, the agitator being adapted to agitate the display balls inside of the container;

(D) a plurality of prize balls;

(E) a ball holder, the ball holder being adapted to hold the prize balls in an individually controlled manner;

(F) a controller, the controller being adapted to select at least one prize ball from among the prize ball in the ball holder and not from the display balls; and (G) a display mechanism, the display mechanism being adapted to communication with the controller and display the selected prize ball to the player.

14. The display device of claim 13 further comprising a positioning mechanism in communication with the controller, the positioning mechanism being adapted to position the selected prize ball relative to the display mechanism, whereby the display mechanism may display the selected prize ball.

15. The display device of claim 13 wherein the agitator comprises an air blower.

16. The display device of claim 15 wherein the display mechanism comprises an air duct, the air duct conducting a stream of air from the container to the ball holder, wherein the selected prize ball is moved by the stream of air.

17. The display device of claim 13 wherein the controller is adapted to activate the agitator.

18. The display device of claim 17 wherein the controller is adapted to activate the agitator before the selected prize ball is displayed by the display mechanism.

19. The display device of claim 13 wherein the selected prize ball appears to originate from the container.

20. The display device of claim 13 wherein the ball holder comprises a plurality of chambers each chamber being adapted to hold a prize ball.

21. A display device for playing a game, the display device comprising:

(A) a plurality of prize balls;

(B) a ball holder, the ball holder being adapted to hold the prize balls in an individually controlled manner;

(C) a controller, the controller being adapted to generate a random number and based upon the random number select a specific prize ball in the ball holder; and (D) a display mechanism, the display mechanism being adapted to communicate with the controller and display the selected prize ball to the player.

22. The display device of claim 21 further comprising a positioning mechanism in communication with the controller, the positioning mechanism being adapted to position the selected prize ball relative to the display mechanism, whereby the display mechanism may display the selected ball.

23. The display device of claim 21 wherein the ball holder comprises at least one chamber, the chamber being adapted to hold at least one ball.

24. The display device of claim 23 wherein the ball holder is cylindrical, the chamber being positioned outwardly from a central axis of the ball holder.

25. The display device of claim 23 wherein the chamber comprises an opening, the opening being adapted to allow the ball to be removed from the chamber.

26. The display device of claim 25 wherein the opening is located on a lower surface of the ball holder, wherein the display mechanism further comprises a gate, the gate being adapted to selectively allow the selected prize ball to fall out of the chamber.

27. The gaming device of claim 26 wherein the display mechanism comprises a display window, the display window being positioned below the chamber and adapted to receive the selected prize ball.

28. The gaming device of claim 27 further comprising a blower, the blower being adapted to produce a stream of air in the display window, wherein the stream of air lifts the selected prize ball into the chamber.

29. A method of playing a game with a player, the method comprising the following steps:

(A) providing a jumbled ball display, the display comprising a container and a plurality of display balls in the container, the container allowing the player to see the display balls;

(B) jumbling the balls in the container;

(C) providing a plurality of prize balls, the prize balls being separated from the jumbled ball display;

(D) selecting a prize ball to be displayed, the prize ball to be displayed being a prize ball and not being a display ball; and (E) displaying the selected prize ball to the player.

30. The method of claim 29 further comprising the step of storing the prize balls in an individually controlled manner.

31. The method of claim 29 wherein the selected prize ball appears to the player to originate from the jumbled ball display.

32. The method of claim 29 further comprising the step of generating a predetermined event before displaying the selected prize ball.

33. The method of claim 29 further comprising the step of awarding a prize to the player.

34. The method of claim 33 wherein the prize awarded to the player is related to the selected prize ball.

35. The method of claim 29 wherein the step of selecting a prize ball comprises randomly selecting the prize ball.

36. The method of claim 35 wherein the step of randomly selecting the prize ball comprises generating a random number.

37. A method of playing a game with a player, the method comprising the following steps:

(A) providing a plurality of prize balls;

(B) storing the prize balls in an individually controlled manner;

(C) generating a random number;

(D) selecting a prize ball based upon the random number; and (E) displaying the selected prize ball to the player.

38. The method of claim 37 wherein the selected prize ball is selected based at least in part on a random event.

39. The method of claim 38 further comprising the step of awarding a prize to the player based at least in part on the random event.

40. The method of claim 37 further comprising the step of providing a jumbled ball display, the jumbled ball display comprising a plurality of display balls, the display balls being separated from the prize balls.

41. The method of claim 40 wherein the selected prize ball displayed to the player appears to originate from the jumbled ball display.

42. A method of playing a game, the method comprising the following steps:

(A) providing a game apparatus, the game apparatus being adapted to allow a player to play a game;

(B) providing a jumbled ball display, the display comprising a container and a plurality of display balls in the container, the container allowing the player to see the display balls in the container;

(C) jumbling the balls in the container;

(D) providing a plurality of prize balls, the prize balls being separated from the jumbled ball display;

(E) selecting a prize ball only from the prize balls, none of the display balls being selected; and (F) displaying the selected prize ball.

43. The method of claim 42 further comprising the step of allowing a player to play a game on the game apparatus.

44. The method of claim 43 wherein the step of jumbling the balls in the container occurs after a predetermined event occurs in the game apparatus.

45. The method of claim 42 further comprising the step of awarding a bonus prize to a player.

46. The method of claim 45 wherein the prize awarded to the player is determined at least in part by the selected prize ball.

47. A gaming device, the gaming device comprising:

(A) a game apparatus, the game apparatus being adapted to allow a player to play a game; and (B) a jumbled ball display device, the display device comprising:

(a) a plurality of display balls;

(b) at least one container, the container being adapted to hold the display balls, the container having at least one portion that is at least partially transparent, wherein the player may view the balls in the container; and (c) at least one agitator, the agitator being adapted to agitate the display balls inside of the container, wherein the jumbled ball display device does not affect the outcome of the game played on the game apparatus; and (C) a prize display in communication with the game apparatus, the prize display being adapted to select a prize ball from among a plurality of prize balls, none of the display balls being selected and display the selected prize ball.

48. The game device of claim 47 wherein the agitator comprises an air blower.

49. The game device of claim 47 further comprising a controller, the controller being adapted to activate the agitator when a predetermined event occurs.

50. The game device of claim 49 wherein the predetermined event is produced by the game apparatus.

51. A gaming device, the gaming device comprising:

(A) a game apparatus, the game apparatus being adapted to allow a player to play a game;

(B) a video display device, the video display device being adapted to display an image of a plurality of display balls;

(C) a plurality of prize balls;

(D) at least one ball holder, the ball holder being adapted to hold the prize balls in an individually controlled manner;

(E) a controller in communication with the video display device, the controller being adapted to select at least one prize ball to be displayed, the prize ball to be displayed being a prize ball in the ball holder and not being one of the display balls; and (F) a display mechanism in communication with the controller, the display mechanism being adapted to display a selected prize ball to the player.

52. The gaming device of claim 51 further comprising a positioning mechanism attached to the ball holder, the positioning mechanism being adapted to position the selected prize ball relative to the display mechanism, whereby the display mechanism may display the selected ball.

53. The gaming device of claim 51 wherein the game apparatus is adapted to produce a bonus-activating event.

54. The gaming device of claim 51 wherein the controller is adapted to detect a bonus-activating event.

55. The gaming device of claim 54 wherein the bonus-activating event is at least one predetermined outcome of the game apparatus.

56. The gaming device of claim 54 wherein the controller is further adapted to signal the video display device to display the image of the display balls in an agitated state after the controller detects a bonus-activating event.

57. The gaming device of claim 51 further comprising an input device in communication with the controller, the input device being adapted to enable the controller to cause the display of the selected prize ball when the player activates the input device.

58. The gaming device of claim 57 wherein the controller is adapted to detect a bonus activating event, wherein the input device is enabled after the controller has detected a bonus activating event.

59. The gaming device of claim 58 wherein the controller automatically causes the display of the selected prize ball if the player does not activate the input device within a predetermined time period after a bonus-activating event has been detected by the controller.

60. The gaming device of claim 51 wherein the selected prize ball selected by the controller determines a prize to be awarded to the player.

61. The gaming device of claim 51 wherein the game apparatus is further adapted to award a prize, wherein the selected prize ball selected by the controller determines a bonus prize to be awarded to the player in addition to a prize awarded by the game apparatus.

62. The gaming device of claim 51 wherein the game apparatus is further adapted to award a prize and the selected prize selected by the controller determines a multiplier, the player being awarded a multiple of the prize awarded by the game apparatus.

63. A display device, the gaming device comprising:

(A) a video display device, the video display device being adapted to display an image of a plurality of display balls;

(B) a plurality of prize balls;

(C) a ball holder, the ball holder being adapted to hold the prize balls in an individually controlled manner;

(D) a controller in communication with the video display device, the controller being adapted to select a prize only from the ball holder, none of the display balls being selected; and (E) a display mechanism in communication with the controller, wherein the controller causes the display mechanism to display the selected prize ball to the player.

64. The display device of claim 63 further comprising a positioning mechanism in communication with the controller, the positioning mechanism being adapted to position the selected prize ball relative to the display mechanism, whereby the display mechanism may display the selected prize ball.

65. The display device of claim 63 wherein the video display device is adapted to display the image of the plurality of display balls in an agitated state.

66. The display device of claim 65 wherein the controller is adapted to signal the video display device to display the image of the plurality of display balls in an agitated state.

67. The display device of claim 66 wherein the controller is adapted to signal the video display device to display the image of the plurality of display balls in an agitated state before the selected prize ball is displayed by the display mechanism.

68. The display device of claim 63 wherein the display mechanism comprises an air duct, the air duct conducting a stream of air from the container to the ball holder, wherein the selected prize ball is moved by the stream of air.

69. The display device of claim 63 wherein the selected ball appears to originate from the video display device.

70. The display device of claim 63 wherein the ball holder comprises a plurality of chambers each chamber being adapted to hold a prize ball.

71. A method of playing a game, the method comprising the following steps:

(A) providing a video display device, the video display device being adapted to display an image of a plurality of display balls;

(B) displaying the image of the plurality of display balls in an agitated state;

(C) providing a plurality of prize balls;

(D) selecting a prize ball only from the prize balls, none of the display balls being selected; and (E) displaying the selected prize ball.

72. The method of claim 71 further comprising the step of storing the prize balls in an individually controlled manner.

73. The method of claim 71 wherein the selected prize ball appears to the player to originate from the video display device.

74. The method of claim 71 further comprising the step of generating a predetermined event before displaying the selected prize ball.

75. The method of claim 71 further comprising the step of awarding a prize to a player.

76. The method of claim 75 wherein the prize awarded to the player is related to the selected prize ball.

77. The method of claim 71 wherein the step of selecting a prize ball comprises generating a random number.

78. A method of playing a game, the method comprising the following steps:

(A) providing a game apparatus, the game apparatus being adapted to allow a player to play a game;

(B) providing a video display device, the video display device being adapted to display an image of a plurality of display balls;

(C) displaying the image of the plurality of display balls wherein the display balls appear to be jumbled;

(D) providing a plurality of prize balls;

(E) selecting a prize ball to be displayed, the prize ball to be displayed being a prize ball and not being a display ball; and (F) displaying the selected prize ball.

79. The method of claim 78 further comprising the step of allowing a player to play a game on the game apparatus.

80. The method of claim 79 wherein the step of displaying the image of the plurality of display balls is performed after a predetermined event occurs in the game apparatus.

81. The method of claim 78 further comprising the step of awarding a bonus prize to a player.

82. The method of claim 81 wherein the prize awarded to the player is determined at least in part by the selected prize ball.

83. A gaming device, the gaming device comprising:

(A) a game apparatus, the game apparatus being adapted to allow a player to play a game and produce a bonus activating event; and (B) a video display device, the video display device being adapted to perform at least the following:

(a) display an image of a plurality of display balls; and (b) display an image of the plurality of display balls in an agitated state;

(C) a plurality of prize balls; and (D) a controller, the controller being adapted to detect the occurrence of a bonus-activating event and signal the video display device to display the images of the display balls in an agitated state and further being adapted to generate a random number, select a prize ball to be displayed based upon the random number, and cause the selected prize ball to be displayed to the player.

84. The gaming device of claim 83 wherein the video display device comprises a memory device, the memory device being adapted to store data for generating video displays.

85. The gaming device of claim 83 wherein the video display device is adapted to display a prize ball, the prize gall appearing to be randomly selected from the plurality of display balls.

* * * * *